US007347253B2

(12) United States Patent
Tauren et al.

(10) Patent No.: US 7,347,253 B2
(45) Date of Patent: Mar. 25, 2008

(54) PLATE HEAT EXCHANGER AND FLOW GUIDE PLATE

(75) Inventors: Kari Tauren, Laitila (FI); Juha Suominen, Uusikaupunki (FI); Mauri Kontu, Kalanti (FI)

(73) Assignee: Vahterus Oy, Kalanti (FI)

( * ) Notice: Subject to any disclaimer, the term of this patent is extended or adjusted under 35 U.S.C. 154(b) by 71 days.

(21) Appl. No.: 10/548,489

(22) PCT Filed: Apr. 8, 2004

(86) PCT No.: PCT/FI2004/000222

§ 371 (c)(1),
(2), (4) Date: Sep. 9, 2005

(87) PCT Pub. No.: WO2004/090450

PCT Pub. Date: Oct. 21, 2004

(65) Prior Publication Data

US 2006/0118284 A1 Jun. 8, 2006

(30) Foreign Application Priority Data

Apr. 8, 2003 (FI) ..... 20030527

(51) Int. Cl.
*F28F 3/08* (2006.01)

(52) U.S. Cl. ..... 165/167; 165/157

(58) Field of Classification Search ..... 165/157, 165/167

See application file for complete search history.

(56) References Cited

U.S. PATENT DOCUMENTS

| | | | | |
|---|---|---|---|---|
| 1,669,062 | A * | 5/1928 | Menzel | 165/167 |
| 5,832,736 | A * | 11/1998 | Yoshioka et al. | 62/225 |
| 6,158,238 | A | 12/2000 | Lampinen et al. | |
| 6,318,456 | B1 * | 11/2001 | Brenner et al. | 165/167 |
| 2003/0000688 | A1 * | 1/2003 | Mathur et al. | 165/167 |
| 2004/0031600 | A1 * | 2/2004 | Kontu | 165/167 |
| 2005/0011639 | A1 | 1/2005 | Kontu et al. | 165/167 |

FOREIGN PATENT DOCUMENTS

| | | |
|---|---|---|
| FR | 2 816 043 | 5/2002 |
| WO | WO 91/09262 | 6/1991 |
| WO | WO 97/45689 | 12/1997 |
| WO | WO 99/30099 | 6/1999 |
| WO | WO 03/031896 A1 | 4/2003 |

OTHER PUBLICATIONS

International Search Report.

* cited by examiner

*Primary Examiner*—Allen J. Flanigan
(74) *Attorney, Agent, or Firm*—Nixon & Vanderhye P.C.

(57) ABSTRACT

The invention comprises a heat exchanger with plate structure and a flow guide plate (32). The flow guide plate (32) comprises at least one recess (42) for turning the stream of a heat transfer medium substantially from the direction of the thickness of the plate to be parallel with the plane of the plate.

8 Claims, 5 Drawing Sheets

B (1 : 2)

C-C

PLATE HEAT EXCHANGER AND FLOW GUIDE PLATE

This application is the U.S. national phase of international application PCT/FI04/00222 filed 8 Apr. 2004 which designated the U.S. and claims benefit of FI 20030527, dated 8 Apr. 2003, the entire content of which is hereby incorporated by reference.

TECHNICAL FIELD OF THE INVENTION

The invention relates to a plate heat exchanger and a flow guide plate as presented in the preambles of the independent claims disclosed hereinbelow. In particular, the invention relates to a novel way of guiding flows for the heat transfer between substances in the same form or in different forms, such as a gas or a liquid, in a plate heat exchanger.

PRIOR ART

A conventional plate heat exchanger is composed of superimposed plates which form a stack of plates which is clamped between two end plates by means of clamping screws. The ducts formed by the plates and the flow openings connected thereto are sealed at their outer perimeters by means of separate sealings. The plates of such plate heat exchangers are typically rectangular in shape, and the flow openings, usually four in number, are placed in the vicinity of the corners. In conventional plate heat exchangers, the streams of the heat transfer medium are normally arranged in such a way that the flow openings at opposite corners are used as inlet and outlet passages, wherein the streams of the primary and secondary sides flow in adjacent ducts formed by heat transfer plates. In conventional plate heat exchangers, it has been possible to step the streams of the primary and secondary sides and to divide them into several draughts by closing the flow openings at desired locations.

Conventional tubular heat exchangers, in which the second heat transfer medium streams in a bundle of tubes fitted inside a cylinder, normally apply plate-like flow guides which are perpendicular to the bundle of tubes. Thus, the stream of the heat transfer medium inside the cylinder, which normally belongs to the secondary side, will pass several times through the bundle of tubes. The number of flow guides can be used to accelerate the stream inside the cylinder and to induce turbulence in the stream, wherein the heat transfer properties can be improved. However, the dimensioning of tubular heat exchangers is normally based on the heat transfer inside the tubes, which is usually smaller than the heat transfer outside the bundle of tubes. The large size of the tubular heat exchangers is largely due to poor heat transfer inside the tube. The diameter of the cylinder of the tubular heat exchanger is normally small compared to the length of the cylinder. The stream inside the cylinder is, in most cases, arranged to flow from one end to the other. Because of the shape of the heat exchanger, there are normally no sealing requirements set for the flow guides used as the support means for the bundle of tubes.

In heat exchangers composed of circular heat transfer plates, in which the stack of plates is placed inside a cylinder, it has been problematic to arrange the stream of the secondary side inside the cylinder in such a way that there is no by-pass flow. In heat exchanger structures of this kind, the stream flowing through the flow guides passes almost all the heat transfer surfaces, thereby substantially reducing the heat transfer properties. For this reason, flexible flow guides made of a metal sheet have been used in heat exchangers, to press rubber sealings or the like against the outer surface of the stack of plates and against the inner surface of the housing of the heat exchanger. The function of these flow guides is to prevent the transverse bypass flow between the stack of plates and the housing. Thanks to their flexible structure, these flow guides have served well in operation. Nevertheless, the rigid spacer plates, which have been used to divide the stream of the secondary side into several draughts, have often proved to be leaky, even though they have been provided with rubber sealings against the stack of plates and the housing.

Finnish patent application 20001860 presents an arrangement for preventing bypass flows of the secondary side. In this construction, the passages of the secondary side are fitted on the housing of the heat exchanger, which is an expensive and bulky solution.

It is an aim of the present invention to reduce or even to eliminate the above-mentioned problems involved in prior art.

In particular, it is an aim of the present invention to produce a welded heat exchanger which is made of circular heat transfer plates and which has the good pressure resistance properties of a tubular heat exchanger, but whose heat transfer properties correspond to the properties of a plate heat exchanger.

To attain the above-mentioned purposes among other things, the plate heat exchanger and the flow guide plate according to the invention are primarily characterized in what is presented in the characterizing parts of the appended independent claims.

The exemplifying embodiments and advantages mentioned in this text apply, with respect to suitable parts, to both the plate heat exchanger and the flow guide plate according to the invention, although this is not always particularly mentioned.

BRIEF DESCRIPTION OF THE INVENTION

A typical heat exchanger with plate structure according to the invention comprises

- a stack of plates, with an end plate at each end of the stack, a first heat transfer medium flowing inside the stack of plates, and
- a housing unit, which consists of the ends supporting the stack of plates and a primarily cylindrical housing surrounding the stack of plates, a second heat transfer medium flowing inside the housing unit, wherein an end space is left between the end plate of the stack of plates and the end of the housing unit.

Advantageously, the heat exchanger according to the invention and its housing unit have the shape of a circular cylinder. Advantageously, the plates in the stack of plates are thus primarily circular heat exchanger plates. Such a heat exchanger can be easily arranged to be strong and efficient. The heat exchanger, the housing unit and the stack of plates may also have other shapes, for example angular shapes.

The typical heat exchanger according to the invention also comprises

- inlet and outlet passages for the first heat transfer medium, extending through the end of the housing unit and extending from the outside of the housing into the stack of plates, and
- inlet and outlet passages for the second heat transfer medium, extending from the outside into the housing unit.

Furthermore, the typical heat exchanger according to the invention comprises at least one flow channel for the second heat transfer medium, arranged between the cylindrical housing and the stack of plates and arranged to convey the second heat transfer medium from the end space along at least a distance in between the housing and the stack of plates. Typically, flow ducts for the heat transfer medium extend from such a flow channel to the spaces between the pairs of plates in the stack of plates. It is possible that there are several flow channels. The flow channel may also extend all the way from one end to the other end of the heat exchanger.

In a typical heat exchanger according to the invention, at least at one end, there is an inlet and/or outlet passage for the second heat transfer medium, arranged through the end of the housing unit and opening to the end space, that is, between the end plate in the stack of plates and the end of the housing unit.

Typically, at this same end, a flow guide plate is provided in the end space, which flow guide plate has a recess into which the inlet and/or outlet passage of the second heat transfer medium opens, which recess is formed to extend from the edge of the flow guide plate along a distance towards the center of the guide plate, to guide the flow of the second heat transfer medium between said recess and the flow channel between the housing and the stack of plates.

In the end space, the flow guide plate, with the recess therein, is so tightly against the end part of the housing and the end plate of the stack of plates that at least most, typically almost all of the heat transfer medium is guided along the recess in the desired direction.

In a typical plate heat exchanger according to the invention, the heat transfer surfaces consist of heat transfer plates attached to each other and collected in a stack of plates which are circular in shape and which have at least two flow openings for the supply and discharge of a heat transfer medium through ducts formed by the plates. The plates of the heat exchanger are typically welded together in pairs at the outer perimeters of the flow openings, and the plate pairs are connected to each other by welding the plates of the plate pairs at their outer perimeters to the plates of other plate pairs. The stack of plates is typically fitted inside a cylindrical housing unit functioning as a pressure vessel.

In a typical plate heat exchanger according to the invention, a typical flow guide according to the invention is fitted between the end plate of the stack of plates and the end plate of the heat exchanger, by means of which flow guide the streams of the heat transfer medium are guided from the space between the end plate of the housing and the end plate of the stack of plates, to the flow channels between the housing and the stack of plates, which flow channels are formed, for example, by thin plates curved against the housing.

A typical flow guide plate is a plate which is primarily solid but has a recess formed to extend a distance from the edge of the plate towards the center of the plate. For this recess, the stream of the heat transfer medium is guided between said recess and the flow channel between the housing and the stack of plates.

The flow guide plate can have the shape of, for example, the letter Z or a crescent or another suitable shape, the guide plate guiding at least substantially all of the stream from the space between the end plate of the housing and the end plate of the stack of plates, to the flow channels between the housing and the stack of plates, or in the opposite direction. The shape of a crescent refers to a plate whose general shape is a circle whose edge is provided with a recess according to the invention, by removing a piece of the plate from the edge.

One flow guide plate according to the invention is primarily a circle, from which, in a way, one sector or a piece from the edge has been removed.

The heat exchanger and the flow guide plate according to the invention provide significant advantages. The streams of the primary and secondary sides can be divided in a desired manner, and the passages required by them can be simply placed only at the ends of the heat exchanger. Thus, the heat transfer conditions can be freely selected, depending on the properties and flow rates of the heat transfer media. The heat exchanger according to the invention can be used as a concurrent, counter-current or cross-flow heat exchanger. In the heat exchanger according to the invention, the heat transfer properties of the heat exchanger are not reduced by uncontrolled by-pass flows. When all the passages of the heat exchanger with plate structure are arranged at the ends of the heat exchanger, in the end plates of the same, the installation work of the heat exchanger becomes easier and new possibilities become feasible for placing the heat exchanger. By means of the guide plate according to the invention, the flows are very easy to guide in the desired directions. By replacing the flow guide plate or even by changing its position only, it is easy to change the properties of the heat exchanger. The invention makes it possible to provide a plate heat exchanger in which no rubber sealings or corresponding sealings are needed to prevent bypass flows. Naturally, sealings can be used, if required in the situation.

The flow guide plate according to the invention is very easy to manufacture. If the guide plate is a plate having a primarily solid area and one or more recesses and/or openings according to the invention, the guide plate is very rigid and firm and easy to install in the correct position in the end space.

The flow guide plate and the recess or recesses formed in it can be easily dimensioned to be suitable for each situation of use. The edges of the recess can form a sector extending to the edge of the plate, wherein the edges of the recess form an angle which is, for example, 10-150°, 30-120°, 50-100° or 70-90°, and most preferably about 80°. The recess may cover, for example, 1-10%, 1-20%, 1-30%, 1-40%, 1-50%, 10-20%, 10-30%, 10-40%, 10-50%, 20-30%, 20-40%, or 20-50% of the surface area of the guide plate. The distance that the recess extends from the edge of the plate towards the center of the plate is typically a substantial part, i.e. 10-50%, 20-50%, 30-50%, 40-50% or more than 50% of the diameter of the plate. The recess may extend, primarily in its whole area, through the guide plate in its thickness direction, or the recess may be a groove made in the surface of the plate, at least in a part of its area.

In one typical application according to the invention, the heat exchanger with plate structure comprises a stack of plates, inside which the second heat transfer medium flows, a housing unit consisting of ends supporting the stack of plates and a housing surrounding the stack of plates, the second heat transfer medium flowing inside the housing unit, and inlet and outlet passages extending through the end, for the heat transfer media flowing in the stack of plates and in the housing unit, as well as inlet and outlet passages for the heat transfer medium flowing in the housing unit, which passages extend to the space between the end plate of the housing unit and the end plate of the stack of plates.

Furthermore, in this application, a flow guide plate is fitted between the end plate of the housing unit and the end plate of the stack of plates, to guide the stream into the flow channel between the housing and the stack of plates, and/or to discharge the flow from the flow channel.

In one typical embodiment according to the invention, the flow guide plate of the heat exchanger with plate structure comprises at least one recess provided at the edge of the plate, to turn the stream substantially from the direction of thickness of the plate to the direction parallel with the plane of the plate.

In one embodiment of the heat exchanger according to the invention, exactly two of the following passages are provided through one end of the housing unit:

the inlet passage for the first heat transfer medium, the outlet passage for the first heat transfer medium, the inlet passage for the second heat transfer medium, the outlet passage for the second heat transfer medium.

Thus, the end plate of such a heat exchanger comprises passages for two streams, that is, for example, one recess according to the invention for the second heat transfer medium and one opening for the first heat transfer medium, or two recesses according to the invention for the second heat transfer medium.

If one end of the heat exchanger is arranged to be penetrated by two passages for the second heat transfer medium and an end plate with two recesses according to the invention, then the other end of the heat exchanger is typically arranged to be penetrated by two passages for the first heat transfer medium and an end plate with two openings for the first heat transfer medium. When the passages for the heat transfer media are arranged through the ends of the heat exchanger, a simple and strong heat exchanger is provided, requiring no passages through its housing.

The advantageous flow guide plate according to the invention has a primarily circular shape. It is thus suitable for heat exchangers with the shape of a circular cylinder.

With respect to its size and shape, the flow guide plate according to the invention is advantageously primarily similar to the end plate in the stack of plates and/or the end of the housing unit, between which it is intended to be installed. Thus, it is easy to make the structure of the heat exchanger strong and tight.

Advantageously, the edges of the recess in the flow guide plate are at least primarily aligned with the edges of the flow channel between the housing and the stack of plates. Preferably, the seams between said edges are arranged to be as tight as possible to guide as great a part of the heat transfer medium as possible from the recess to the flow channel, or vice versa.

The flow guide plate can be made of, for example, metal or plastic. The recesses and openings in the flow guide plate can be made, for example, by welding or by cutting from a plate with a circular or other shape. A plastic guide plate can be moulded directly to its correct shape.

In addition to those mentioned above, also other embodiments and their advantages will be presented in the appended figures and in the dependent claims.

BRIEF DESCRIPTION OF THE FIGURES

In the following, the invention will be described in more detail with reference to the appended schematic drawing, in which.

DETAILED DESCRIPTION OF PREFERRED EMBODIMENTS

Figure 1:
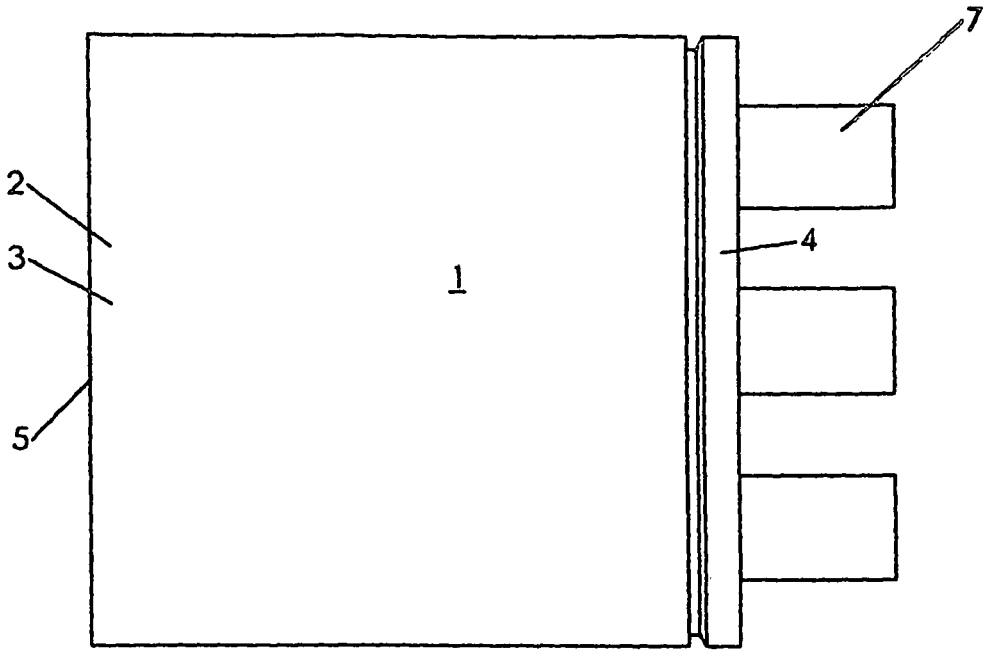
FIG. 1 shows a welded heat exchanger with plate structure according to the invention in a side view.
Figure 2:
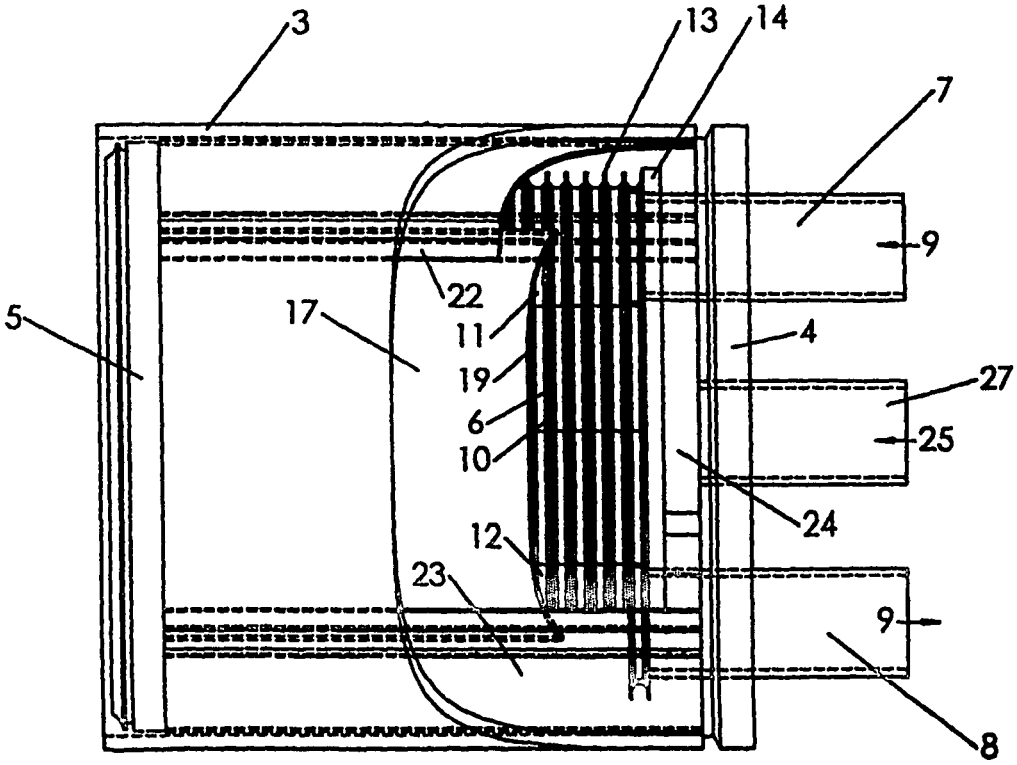
FIG. 2 shows the heat exchanger of FIG. 1 in a partial cross-section in a side view.
Figure 3:
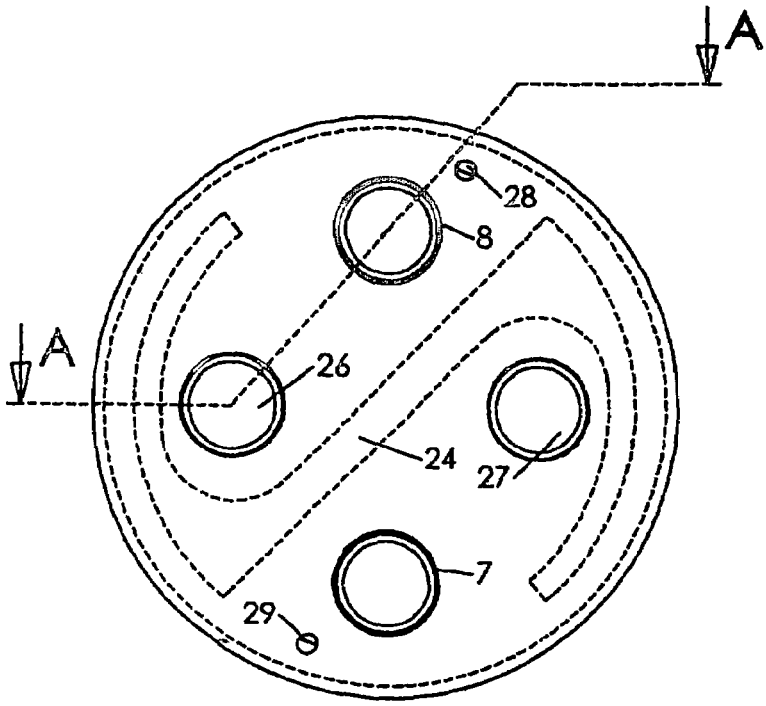
FIG. 3 shows the heat exchanger of FIG. 1 in an end view.
Figure 4:
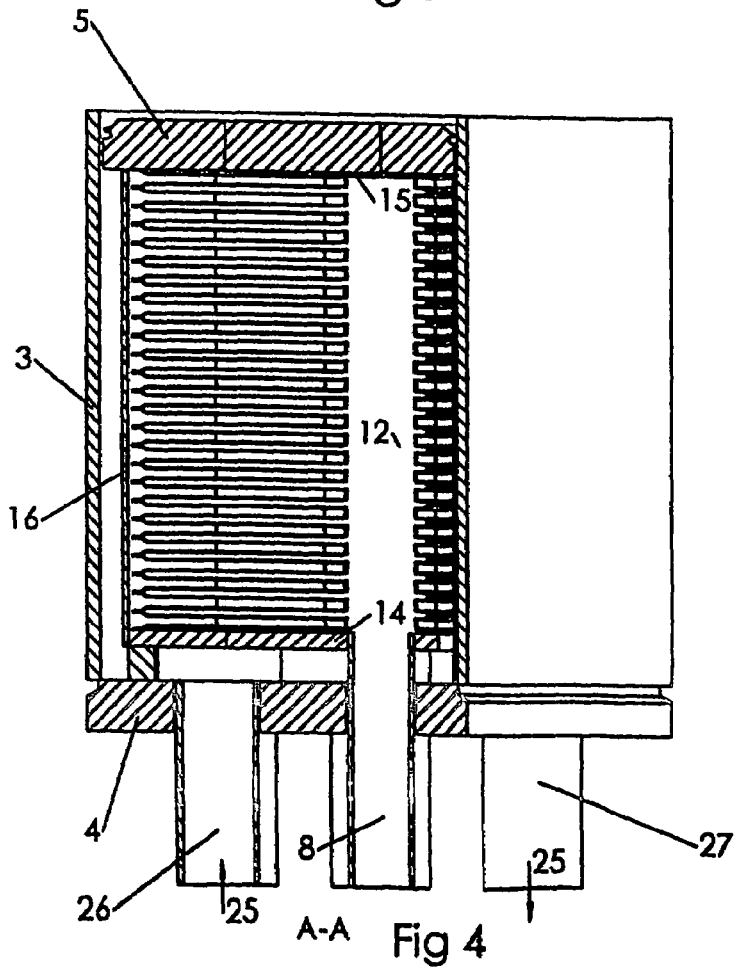
FIG. 4 shows the heat exchanger of FIG. 1 in a cross-section cut at the line A-A of FIG. 3, in a top view.
Figure 6:
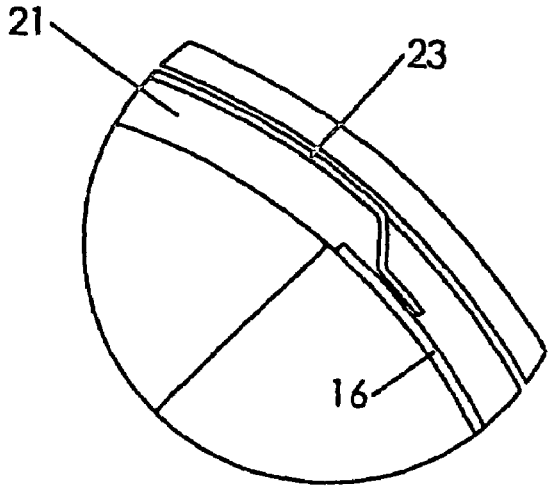
FIG. 6 shows part B of FIG. 5 in an enlarged view.
Figure 5:
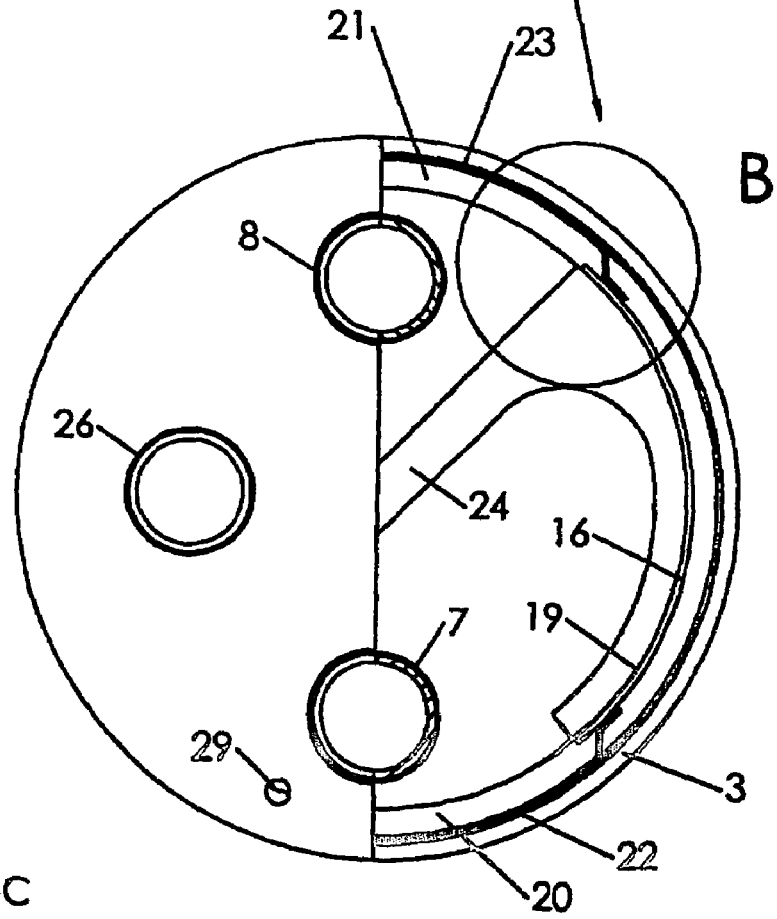
FIG. 5 shows the heat exchanger of FIG. 1 in a partial cross-section in an end view.

FIGS. 1 to 6 show schematically a welded heat exchanger with plate structure according to the invention, in which all the passages are fitted in the end of the housing unit. The housing unit 2 used as a pressure vessel for the heat exchanger 1 with plate structure comprises a housing 3 and end plates 4 and 5 which are fixed to the housing 3 in a stationary manner. The housing unit 2 accommodates a stack 6 of plates forming the heat transfer surfaces, which stack can be removed for cleaning and maintenance, for example, by connecting one of the ends 4, 5 to the housing 3 by means of a flange joint. A heat transfer medium flowing inside the stack 6 of plates forms a primary stream which is led into the stack 6 of plates through the end plate 4 via an inlet passage 7 and is discharged via an outlet passage 8 in the end 4. The passage of the primary stream is illustrated with arrows 9.

The stack 6 of plates forms the heat exchange surfaces of the heat exchanger 1, which are composed of circular grooved heat transfer plates 10 connected to each other. The heat transfer plates 10 are connected together in pairs by welding at the outer perimeters of flow openings 11 and 12, and the pairs of plates are connected to each other by welding at the outer perimeters 13 of the heat transfer plates 10. The flow openings 11 and 12 constitute the inlet and outlet passages of the primary stream inside the stack 6 of plates, through which passages the heat transfer medium is led and discharged from the ducts formed by the heat transfer plates.

The stack 6 of plates is assembled and pre-tightened by welding the end plates 14, 15 in the stack 6 of plates together with side support plates 16, 17. To avoid a by-pass flow of the heat transfer medium in the space between the stack 6 of plates and the side support plates 16, 17, the space is provided with rubber sealings 18, 19 or the like before the assembly. Between the housing 3 and the stack 6 of plates, flow channels 20, 21 are provided by means of plates 22 and 23. The plates 22, 23 are welded together with the side support plates 16, 17. The plates 22 and 23 are curved against the housing 3, and their edges are used as springs to press the side support plates 16, 17 and the rubber sealings 18, 19 against the stack 6 of plates.

In the example shown in FIGS. 1 to 6, a flow guide 24 with the shape of the letter Z is fitted between the end plate 3 of the housing unit 2 and the end plate 14 of the stack 6 of plates, to divide the space between the end plates 4, 14 in two parts. The inlet and outlet passages 26, 27 of the secondary stream, which is shown by arrows 25, are connected to the end plate 4 of the housing unit 2. The stream 25 from the inlet passage 26 into the space between the end plates 4, 14 is guided into the channel 21 formed by the plate 23. In a corresponding manner, the stream 25 coming from the channel 20 formed by the plate 22 into the space between the end plates 4, 14 and to be discharged, is guided by the flow guide 24 to the outlet passage 27 and further out of the heat exchanger. For emptying and aeration of the heat exchanger, the end plate 4 of the housing unit 2 is provided with aeration and emptying screws 28, 29.

The heat exchanger 1 with plate structure according to the invention is normally used by adjusting and controlling the streams of the primary and secondary sides. If the plates 22, 23 of the flow channels 20, 21 are not elements of a pressure vessel, then one should possibly take into account, when starting the device for the first time, that a given delay time must be allowed for the filling of the flow channels 20, 21, as well as the adjacent spaces, with the heat transfer medium. When turning on the heat exchanger 1, aeration must be performed via the screws 28, 29. In a corresponding manner, the heat exchanger 1 can be emptied via the screws 28, 29, depending on the position of the assembly.

For example, the external shape of the flow guide 24 in the welded heat exchanger 1 with plate structure, having the shape of the letter Z, may vary freely as long as the space is divided in two parts by the piece, to prevent by-pass flows. Furthermore, the spaces inside the housing 3 and the side support plates 16, 17 can be filled with the heat transfer medium in another way than that presented above.

Figure 7:
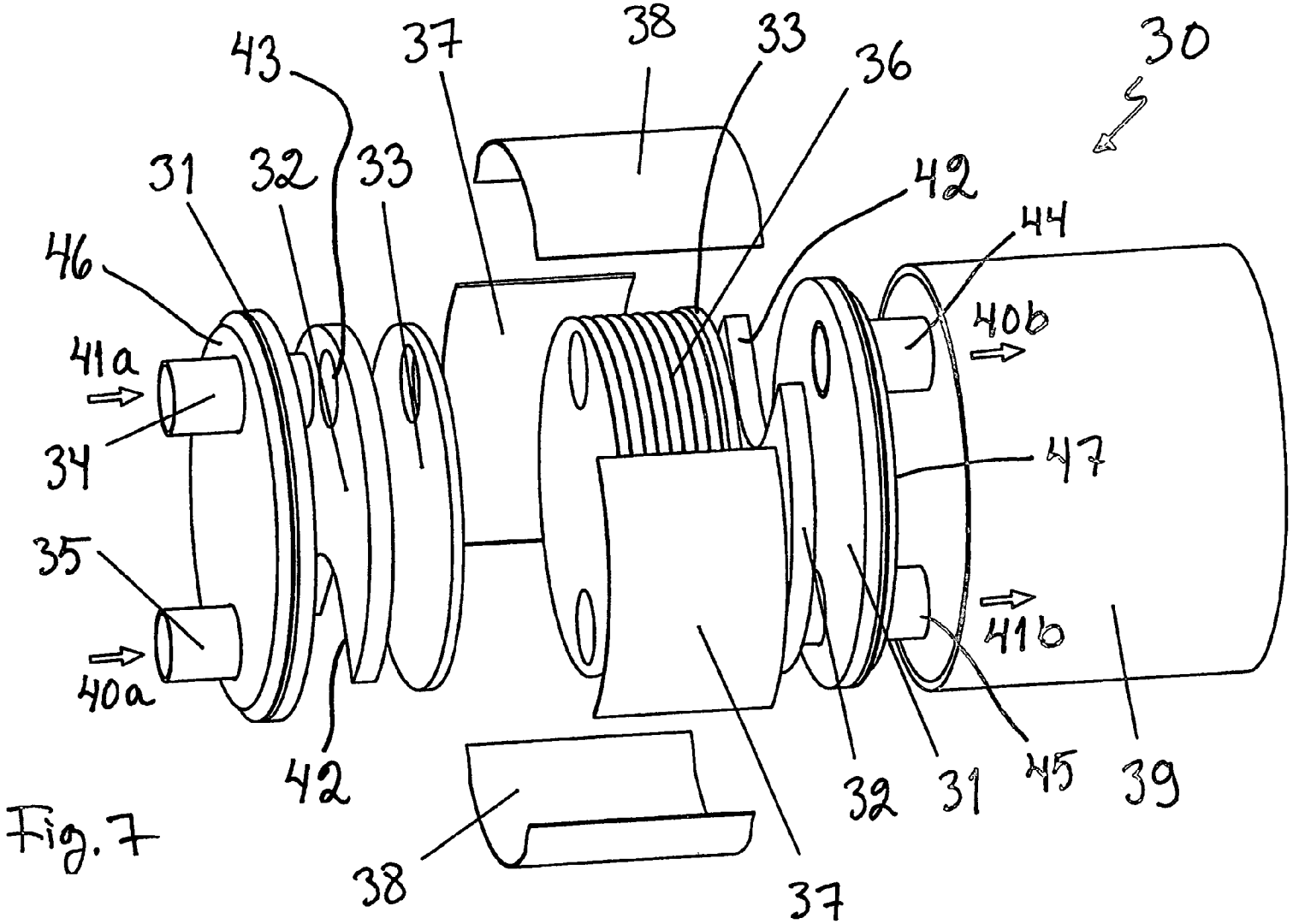
FIG. 7 shows the welded heat exchanger with plate structure according to the invention in an exploded view.
Figure 8:
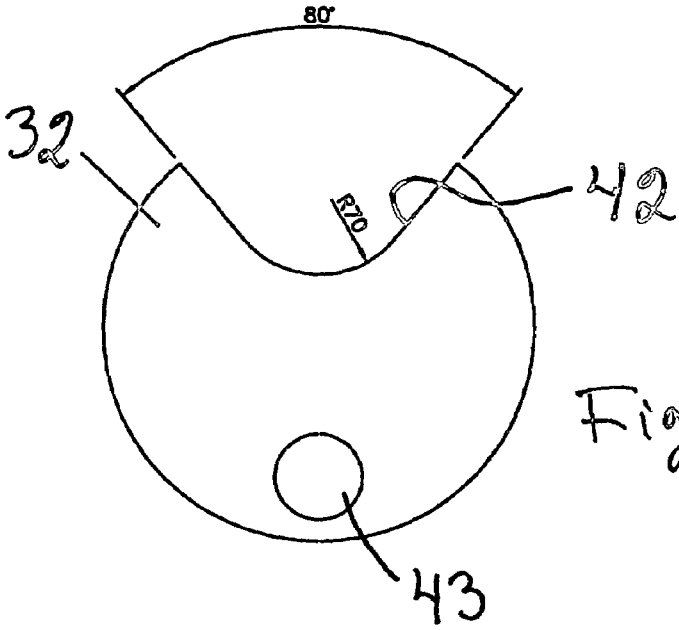
FIG. 8 shows the cross-section of the end of the heat exchanger according to FIG. 7 in a side view.
Figure 9:
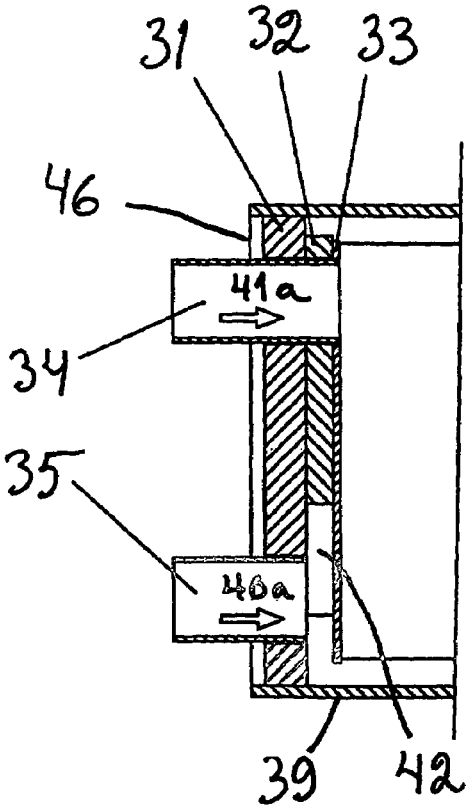
FIG. 9 shows a flow guide according to the invention of the heat exchanger of FIG. 7.

FIGS. 7 to 9 show a plate heat exchanger 30 according to the invention, comprising a housing 39, housing end plates 31, flow guide plates 32 according to the invention, end plates 33 of the stack of plates, and a stack 36 formed of several heat exchanger plates welded together. Typically, the plates 37 are arranged to be tightly connected over their whole length to the stack 36 of plates. In this way, the stream is guided into the spaces between the plates in the stack of plates and, from these spaces, only to the flow channels formed of the curved plates 38. In the heat exchanger 30 shown in FIGS. 7 to 9, a first stream 41*a* is introduced from the first end 46 of the heat exchanger via a passage 34 first through the end plate 31 of the housing, then through an opening 43 in the flow guide plate 32, and finally through the end plate 33 of the stack of plates further into the stack 36 of plates. In the same way, the first stream 41*b* is guided out from the other end 47 of the heat exchanger, via a channel 45. The second stream 40*a* is introduced through the first end 46 of the heat exchanger via a channel 35 through the end plate 31 of the housing into the space between the end plate 31 and the end plate 33 of the housing. The flow guide plate 32 arranged between these plates 31 and 33 is provided with a guide recess 42 which guides the second stream to the outer periphery of the heat exchanger, into a flow channel formed by the plate 38. From the flow channel, the second stream is guided from between the plates in the stack of plates to a second corresponding flow channel arranged on the other side of the stack of plates, and from there further via a guide recess 42 in a second flow guide plate 32 according to the invention into a channel 44, to be discharged as a stream 40*b* from the second end 47 of the heat exchanger.

In the heat exchanger 30 of FIG. 7, both of the streams 40 and 41 are arranged to be introduced via the first end 46 of the heat exchanger and to be discharged from the second end 47. It is easy to understand that by means of the flow guide plates according to the invention, the streams of the heat exchanger can also be easily arranged so that the inlet and outlet passages of one and the same medium are provided at the same end of the heat exchanger. Furthermore, it is also easy to arrange all the four passages in the same end.

FIG. 8 shows a flow guide plate 32 according to the invention which has primarily the shape of a crescent and whose one edge is provided with a guide recess 42 by removing a part of the edge from the plate. The number of guide recesses 42 may be more than one, and they may be different in shape. If the plate is provided with a recess 42 on both of its edges, it is very suitable, for example, for the above-mentioned case in which the inlet and outlet passages of one and the same medium are provided in the same end of the heat exchanger. Such a plate with two recesses will easily guide the incoming stream first to one edge of the heat exchanger, into the flow channel formed by the plate 38, and then again out of the second flow channel and out of the heat exchanger. The plate could also be provided with, for example, two guide recesses 42 for one stream and two openings 43 through the plate for the other stream to be guided into the stack of plates.

The edges of the recess 42 in the flow guide plate are aligned with the edges of the flow channel formed by the plate 38. The seams between said edges are arranged to be as tight as possible to guide as great a part of the heat transfer medium as possible from the recess 42 to the flow channel, or vice versa.

The figures only show a few particularly advantageous embodiments of the invention. The figures or their descriptions do not separately disclose facts which are of secondary importance with respect to the main idea of the invention, which are known as such, or which are obvious as such for a person skilled in the art. However, after reading this text, a person skilled in the art will appreciate how and why such facts, known as such, should be arranged. The heat exchanger, the stack of plates, the flow guide plate according to the invention, or the recesses and openings provided therein, may vary in size and shape. It will be obvious for a person skilled in the art that the invention is not limited solely on the examples presented above, but the invention may vary within the scope of the independent claims presented hereinbelow. The dependent claims will present some possible embodiments of the invention, and they must not be considered to restrict the scope of invention as such.

The invention claimed is:

1. A heat exchanger with a plate structure, comprising:

a stack of plates inside which a first heat transfer medium is allowed to flow, the stack of plates including an end plate at each end of the stack, a housing unit inside which a second heat transfer medium is allowed to flow, the housing unit including ends supporting the stack of plates and a primarily cylindrical housing surrounding the stack of plates, wherein an end space is left between the end plate of the stack of plates and the end of the housing unit, inlet and outlet passages for the first heat transfer medium, penetrating through the end of the housing unit and extending from the outside of the housing to the inside of the stack of plates, inlet and outlet passages for the second heat transfer medium, extending from the outside of the housing unit to the inside of the housing unit, and at least one flow channel for the second heat transfer medium, arranged between the cylindrical housing and the stack of plates and arranged to convey the second heat transfer medium from the end space along at least a distance into the space between the housing and the stack of plates, wherein in at least one end of the heat exchanger, the end of the housing unit is arranged to be penetrated by an inlet and/or outlet passage for the second heat transfer medium, opening into the end space, a flow guide plate is provided in the end space, which flow guide plate has a recess into which the inlet and/or outlet passage for the heat transfer medium opens, which recess is formed to extend from the edge of the flow guide plate along a distance towards the centre of the guide plate, to guide the stream of the second heat transfer medium between said recess and the flow channel between the housing and the stack of plates, the end of the housing unit is arranged to be penetrated by an inlet and/or out-let passage for the first heat transfer medium, and the flow guide plate is provided with an opening to guide the first heat transfer medium through the guide plate.

2. A heat exchanger with plate structure, comprising a stack of plates inside which a first heat transfer medium is allowed to flow, the stack of plates including an end plate at each end of the stack, a housing unit inside which a second heat transfer medium is allowed to flow, the housing unit including ends supporting the stack of plates and a primarily cylindrical housing surrounding the stack of plates, wherein an end space is left between the end plates of the stack of plates and the end of the housing unit, inlet and outlet passages for the first heat transfer medium, penetrating through the end of the housing unit and extending from the outside of the housing to the inside of the stack of plates, inlet and outlet passages for the second heat transfer medium, extend mg from the outside of the housing unit to the inside of the housing unit, at least one flow channel for the second heat transfer medium, arranged between the cylindrical housing and the stack of plates and arranged to convey the second heat transfer medium from the end space along at least a distance into the space between the housing and the stack of plates, wherein in at least one end of the heat exchanger, the end of the housing unit is arranged to be penetrated by an inlet and/or outlet passage for the second heat transfer medium, opening into the end space, a flow guide plate is provided in the end space, which flow guide plate has a recess into which the inlet and/or outlet passage for the heat transfer medium opens, which recess is formed to extend from the edge of the flow guide plate along a distance towards the center of the guide plate, to guide the stream of the second heat transfer medium between said recess and the flow channel between the housing and the stack of plates; and wherein one end of the housing unit is arranged to be penetrated by exactly two of the following passages:

the inlet passage for the first heat transfer medium, the outlet passage for the first heat transfer medium, the inlet passage for the second heat transfer medium, the outlet passage for the second heat transfer medium.

3. The heat exchanger according to claim 1 or 2, wherein the flow channel between the housing and the stack of plates consists of a plate or plates curved against the housing and tightly connected at their edges to the stack of plates.

4. The heat exchanger according to claim 1 or 2, wherein the sides of the plates of the flow channels between the housing and the stack of plates are sealed with rubber or Teflon sealings, and that the sides are curved so that they act like a spring, pressing the rubber or Teflon sealings against the stack of plates.

5. The heat exchanger according to claim 1 or 2, wherein the flow guide has the shape of the letter Z or a crescent.

6. The heat exchanger according to claim 1 or 2, wherein side support plates are provided between the housing and the stack of plates, and that the inner spaces between the side support plates and the housing of the housing unit are filled with an flowing heat transfer medium.

7. The heat exchanger according to claim 1 or 2, wherein the plates forming the flow channels between the housing and the stack of plates comprise at least one opening for conveying the heat transfer medium into the internal spaces between the housing and the side support plates of the stack of plates.

8. The heat exchanger according to claim 1 or 2, wherein the edges of the recess in the flow guide plate are at least primarily aligned with the edges of the flow channel between the housing and the stack of plates.

* * * * *